US005409109A

United States Patent [19]

Smith

[11] Patent Number: 5,409,109

[45] Date of Patent: Apr. 25, 1995

[54] ENCLOSED ARROW QUIVER

[76] Inventor: Brian K. Smith, 1734 Ferry St., Shelton, Wash. 98584

[21] Appl. No.: 272,818

[22] Filed: Jul. 11, 1994

[51] Int. Cl.[6] ..... B65D 85/00; A63B 67/00

[52] U.S. Cl. ..... 206/315.11; 206/144; 206/146; 224/916; 124/23.1

[58] Field of Search ..... 206/315.11; 124/23.1; 224/916; 273/416

[56] References Cited

U.S. PATENT DOCUMENTS

| | | | |
|---|---|---|---|
| 2,771,620 | 11/1956 | Hoffman | 206/315.11 |
| 2,984,277 | 5/1961 | Neff | 206/315.11 |
| 3,010,502 | 11/1961 | Sundquist | 206/315.11 |
| 3,434,638 | 3/1969 | Beynon | 224/1 |
| 4,073,328 | 2/1978 | Franklin | 150/1.5 R |
| 5,190,022 | 3/1993 | Larson | 124/25.7 |

*Primary Examiner*—Paul T. Sewell
*Assistant Examiner*—Tara Laster
*Attorney, Agent, or Firm*—Henry S. Miller; David L. Baker; Rhodes & Ascolillo

[57] ABSTRACT

A quiver for safely storing and transporting hunting and target arrows including a symmetrically shaped two piece housing with means for selectively storing arrows and foam in the end of each section for preventing relative movement of the arrows. The two sections of the housing are joined by a rail and grove arrangement whereby the ends of the sections form a staggered interface, allowing convenient access to the arrows. A harness attached to the quiver allows it to be carried over the shoulder or in the hand as desired. When the quiver is joined and locked it is highly resistant to moisture and dampness.

13 Claims, 4 Drawing Sheets

ENCLOSED ARROW QUIVER

BACKGROUND OF THE INVENTION

1. Field of the Invention

The invention relates generally to the field of archery and more specifically to a quiver used for both transportation and storage of arrows and equipment.

2. Description of the Prior Art

Archery has become an increasingly popular sport in recent times, both in terms of hunting and target competition. Although the rules of each aspect of the sport differ vastly, the equipment has become highly specialized for the intended purpose. Probably the least developmental change has occurred in the quiver. U.S. Pat. No. 4,073,328 issued Feb. 14, 1978 to Franklin discloses a hunting quiver having a light weight frame, a protective cup, a pair of bridges with slotted members to support the arrows and a carrying harness. Franklin's background to his invention is particularly note worthy with regard to hunting quivers and is incorporated by reference herein. The U.S. Pat. No. 3,434,638 issued Mar. 25, 1969 to Beynon discloses a quiver for hunting arrows including a foamed material 22 for protecting the arrow head 48. U.S. Pat. No. 5,190,022 issued Mar. 2, 1993 to Larson shows a quiver with an adjustable shaft clamp for arrows having various size shafts. The prior art fails to anticipate the quiver of this invention.

SUMMARY OF THE INVENTION

The invention is a protective quiver enclosure that will allow the user to store, transport and use the arrows in a safe, convenient and cooperative way. The quiver is an elliptical tube, formed in two pieces having domed distal ends and open proximal ends that mate in a staggered symmetrical manner. The pieces of the tube are generally symmetrical in shape and are joined along a staggered interface which traverses the central longitudinal area of the container and terminate in two perpendicularly oriented seams extending radially outward.

The tube is made from a hard, light weight plastic such as poly vinyl chloride or similar material. A first piece or section of the tube has a series of flexible arrow compartments along its longer wall and is adapted to be used independently as a quiver. The domed distal end of this section is faced with hard foam into which the tips of arrow heads can be embedded and firmly retained. The side wall of the tube opposite from the longer wall is cut away and affords ready access to the arrows. A second, mating section has a soft foam lining at its domed end which serves to retain stored arrows when in transit and prevents rattling of the arrows when the tube is moved. A utility box is integrated into the longer side of the second section. The dual purpose box is used to store necessities such as broad tips, field tips, Allen wrenches and the like which are common to the sport. The box is located approximately central to the midpoint of the closed container and serves to locate the center of gravity of the assembled unit and effectively balance it for easier carrying.

The quiver also includes a simple harness which may be use to carry the quiver in hand or on the back.

It is therefore an object of the invention to provide a new and improved arrow quiver.

It is another object of the invention to provide a new and improved arrow quiver that is strong, light in weight and easy to use.

It is a further object of the invention to provide a new and improved arrow quiver that allows for convenient storage and transportation of arrows of different styles, makes and designs.

It is still another object of the invention to provide a new and improved arrow quiver that includes a utility box for spare parts and tools.

It is still a further object of the invention to provide a new and improved arrow quiver that is better balanced then any hitherto known.

It is another object of the invention to provide a new and improved arrow quiver that may be easily and efficiently manufactured and marketed.

It is another object of the invention to provide a new and improved arrow quiver which is of a durable and reliable construction.

These and other advantages, features and objects of the invention will become more apparent from the following description taken in connection with the illustrative embodiment in the accompanying drawings.

DESCRIPTION OF THE ILLUSTRATED EMBODIMENTS

Figure 1:
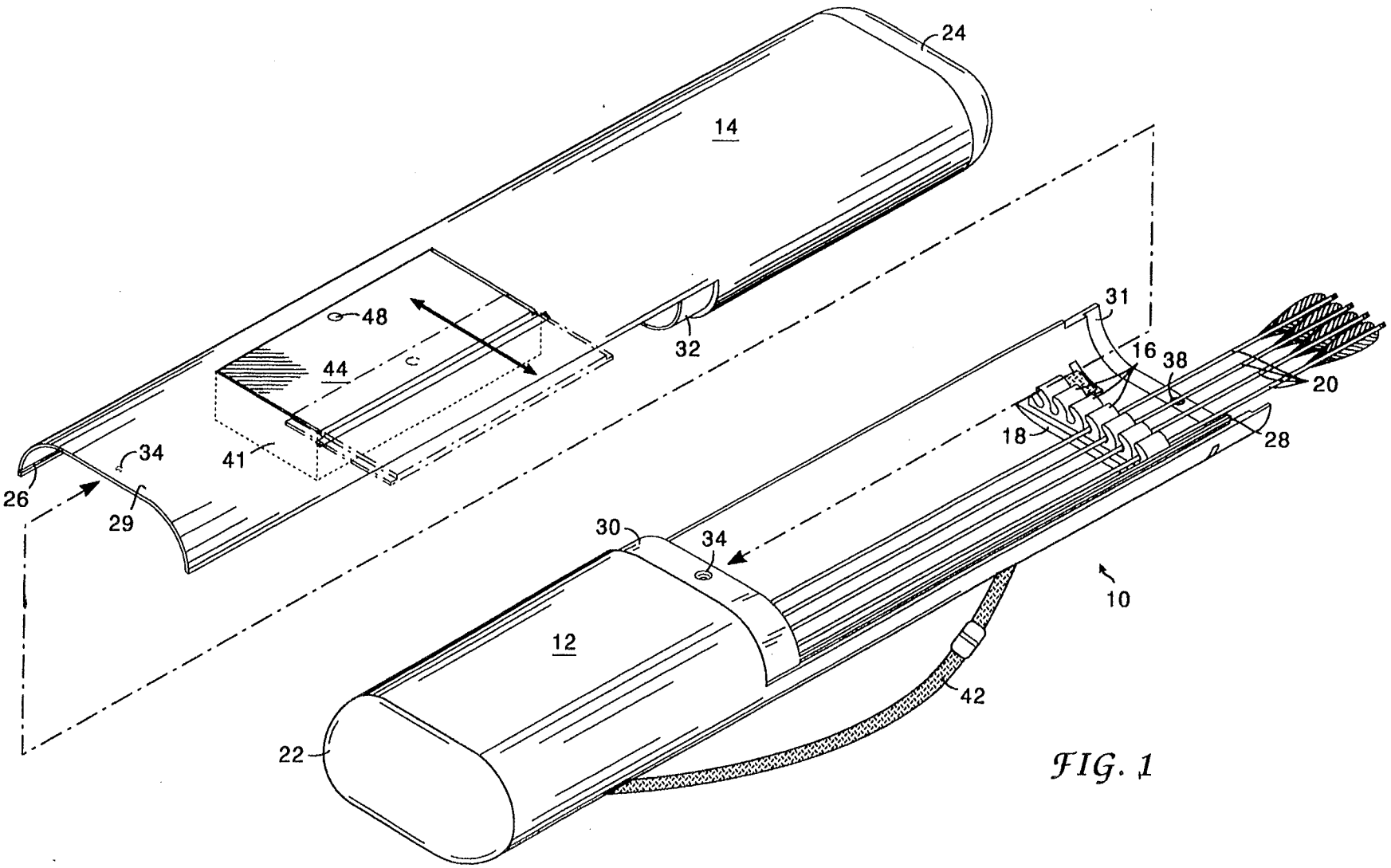
FIG. 1 is a perspective view of the invention.
Figure 2:
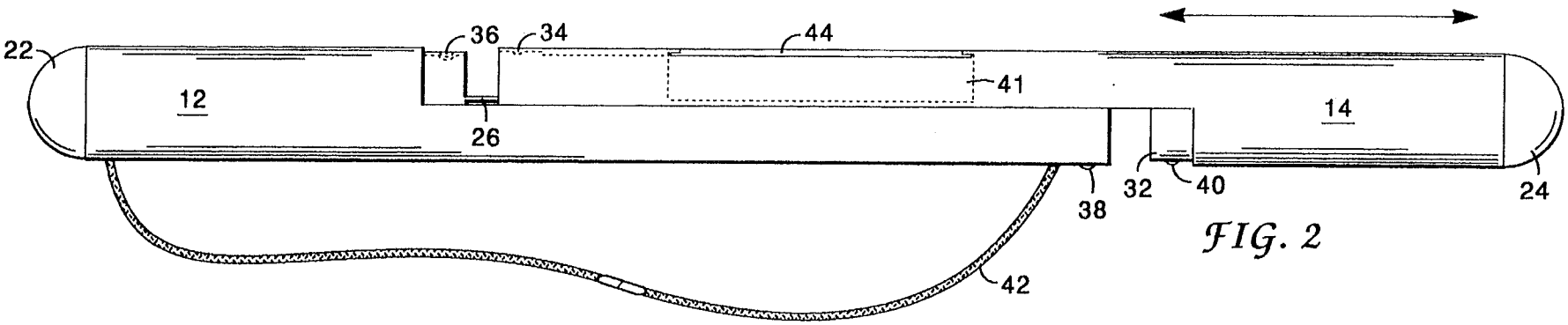
FIG. 2 is a side elevation view of the invention partly expanded.

Referring now to FIGS. 1 and 2, the arrow quiver of the invention is shown generally at 10. A first section of the case is shown as 12 and a second section is shown at 14. A series of arrow shaft clips 16 are mounted on a support 18 and affixed to the interior surface of the section 12 for securing arrows 20.

The case is formed from a strong, light weight plastic such as poly vinyl chloride. The interior of the case may be lined with leather or some other fine durable material. Distal ends 22 and 24 of the case are dome shaped, the interior of each dome is filled with a foam plastic which engages the end of the arrows and protects and keeps them from rattling during transport.

The first and second sections engage each other through a rail and groove system 26,28. Ends of each section override the ends of the opposite section and are shown as 31,32 and 29,30. When closed, the sections are held in position by snaps 34, 36 and 38,40 as shown. The first section may include a simple harness 42 to assist in transporting the quiver containing the arrows. The second section contains a utility compartment shown in phantom at 41 with a sliding cover 44 secured by latch 48.

Figure 3:
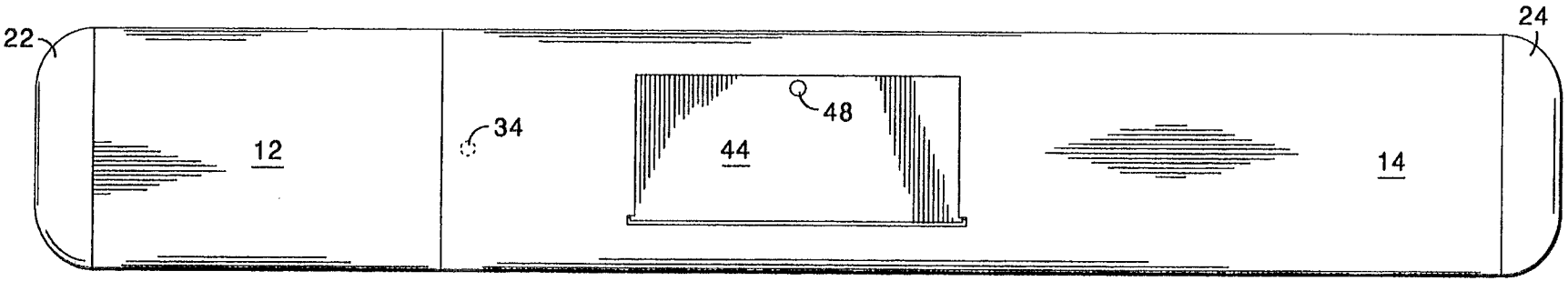
FIG. 3 is a plan view of one side of the invention.
Figure 4:
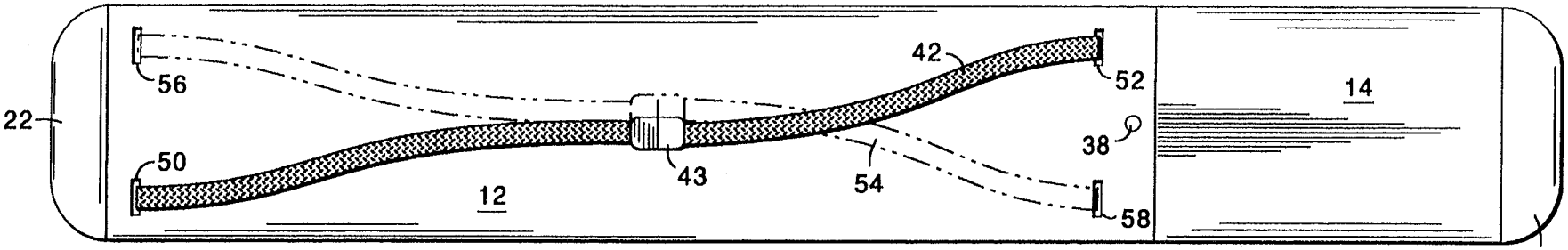
FIG. 4 is a plan view of another side of the invention.

Concerning FIGS. 3 and 4, the quiver is shown in plan view. First section 12 contains provision for a carrying harness 42 which may be adjustable at 43. In one configuration the harness 42 is engaged at fasteners 50 and 52. In an alternative configuration, harness 54 shown in phantom is engaged at fasteners 56 and 58. In a further alternative, both harness 42 and harness 54 could be used together for carrying the closed quiver by hand.

Figure 5:
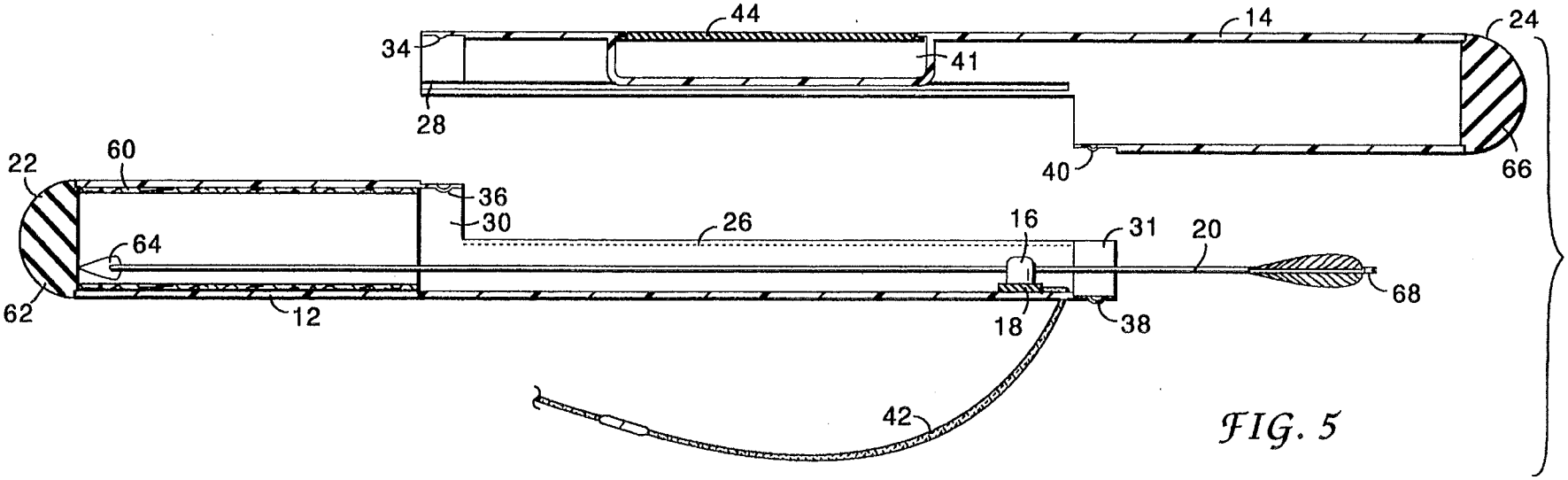
FIG. 5 is a cross sectional view of the invention.

Regarding FIG. 5, the quiver is shown in cross section. Utility compartment 41 is shown with cover 44 in the closed position in the second section. Grove 28 is shown along the longitudinal edge of the opening to the second section. Rail 26 is shown in phantom along the longitudinal edge of the first section. Each section has a pair of longitudinal edges where either the rail or grove is located. The rails and groves engage to secure closure of the quiver. When the quiver is completely closed and secured it is highly resistant to moisture from rain and ambient dampness. A substantial portion of the interior of the quiver is covered with a finishing material 60 such as leather. The domed end of the first section 22 is filled with a hard foam 62 which secures the tip of arrow 64. The domed end 24 of second section 14 is filled with a soft foam 66 which engages and secures the end of arrow 68.

Figure 6:
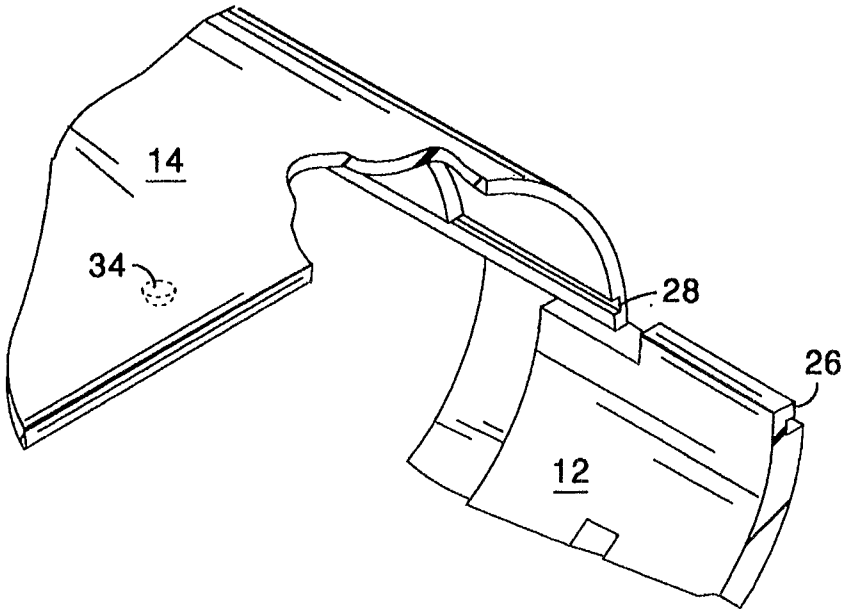
FIG. 6 is a detail view showing the rail and groove engagement between the parts of the invention.

Regarding FIG. 6, the second section 14, is shown as grove 28 is in position to engage rail 26 of first section 12. As the pieces are brought together the grove and rail on each side become engaged and a relative sliding movement takes place and when the pieces are in full engagement snap 34 of section 14 engages snap 36 of section 12, snaps 38 and 40 are engaged.

It should be understood, of course, that the foregoing disclosure relates to only a preferred embodiment of the invention and that numerous modifications or alterations may be made therein without departing from the spirit and scope of the invention as set forth in the appended claims.

What is claimed is:

1. A quiver for the safe transport and storage of hunting or target arrows comprising: a container defined by a tubular housing formed from first section and second sections, symmetrical in shape and joined along a staggered interface which traverses the central longitudinal axis of the container and terminates in two seams parallel to the said longitudinal axis; means located along each of said seams for joining the said sections; means for closing the ends of the housing; means located in one of the sections for selectively storing arrows; means at the closed end of each section for engaging stored arrows and preventing relative movement, and means for locking the joined first and second sections in a joined relation.

2. A quiver according to claim 1 wherein: the means for joining the sections includes a groove and rail engagement means compatibly mounted on each section and allowing translational movement of the sections along the longitudinal axis of the housing and causing a staggered, overlapping closure of the housing sections.

3. A quiver according to claim 2 wherein: the housing is elliptical in shape.

4. A quiver according to claim 3 wherein: the housing is formed of a hard plastic.

5. A quiver according to claim 4 wherein: the ends of the housing are dome shaped.

6. A quiver according to claim 5 wherein: the means for engaging stored arrows is a hard foam.

7. A quiver according to claim 5 wherein: the means for engaging stored arrows is a soft foam.

8. A quiver according to claim 1 wherein: the means for locking is a snap lock.

9. A quiver according to claim 8 wherein: the means for locking is a pair of snap locks.

10. A quiver according to claim 1 further including: a harness adjustably affixed to the housing for transporting the quiver.

11. A quiver according to claim 1 further including: a container mounted in a section of the housing.

12. A quiver according to claim 11 wherein: the container includes a sliding, releasably secured cover.

13. A quiver according to claim 12 wherein: the container is accessible from outside the housing.

* * * * *